US008156949B2

(12) United States Patent
Albert et al.

(10) Patent No.: US 8,156,949 B2
(45) Date of Patent: Apr. 17, 2012

(54) COSMETIC STORAGE AND APPLICATION DEVICE

(76) Inventors: Lettie Albert, Orlando, FL (US); Rafeea Noorhassan, Orlando, FL (US)

( * ) Notice: Subject to any disclaimer, the term of this patent is extended or adjusted under 35 U.S.C. 154(b) by 369 days.

(21) Appl. No.: 12/287,016

(22) Filed: Oct. 3, 2008

(65) Prior Publication Data

US 2009/0293905 A1 Dec. 3, 2009

Related U.S. Application Data

(60) Provisional application No. 61/130,346, filed on May 30, 2008.

(51) Int. Cl.
*A45D 33/28* (2006.01)
*A45D 42/02* (2006.01)
*B65D 71/00* (2006.01)

(52) U.S. Cl. ..... 132/297; 132/301; 206/581; 206/823

(58) Field of Classification Search ..... 132/297, 132/73, 73.5, 75, 76.2, 286, 290, 291, 293, 132/294, 295, 296, 298–301, 314–318, 218, 132/287, 288, 303; 220/4.22, 4.27, 848, 220/810, 847; D28/76, 83, 86, 61; 206/581, 206/443, 823, 747, 748, 745
See application file for complete search history.

(56) References Cited

U.S. PATENT DOCUMENTS 1,336,216 A * 4/1920 Garbeil ..... 132/297
1,455,432 A * 5/1923 Dodson ..... 132/295
1,492,381 A * 4/1924 Lindenmayer ..... 453/54
1,591,515 A * 7/1926 Diskin ..... 132/315
1,601,892 A * 10/1926 Thralls ..... 132/296
1,683,851 A * 9/1928 Wells ..... 206/236
1,725,271 A * 8/1929 Hedman ..... 206/228
1,999,328 A * 4/1935 Lessard ..... 132/315
2,458,063 A * 1/1949 Dulberg ..... 132/314
2,570,341 A * 10/1951 Hake ..... 220/840
2,570,596 A * 10/1951 Ross ..... 132/314
2,590,329 A * 3/1952 Kromray ..... 401/124
2,825,085 A * 3/1958 Ingraham ..... 401/19
3,441,033 A * 4/1969 Flax ..... 132/295
4,056,111 A 11/1977 Mantelet
4,630,954 A * 12/1986 Ladd, Jr. ..... 401/123
4,815,483 A * 3/1989 DuGrenier et al. ..... 132/295
D301,771 S * 6/1989 Bakic ..... D28/76
5,178,478 A * 1/1993 Ryder ..... 401/195
5,226,541 A * 7/1993 Huang ..... 206/581
5,337,890 A * 8/1994 Lai ..... 206/235
5,513,754 A * 5/1996 Chang ..... 206/581
5,520,203 A 5/1996 Segerstrom
5,715,848 A 2/1998 Conley, Jr.
5,738,122 A * 4/1998 Armbruster et al. ..... 132/290
5,881,742 A * 3/1999 Hunsberger ..... 132/297
6,123,198 A * 9/2000 Pflueger et al. ..... 206/581
(Continued)

*Primary Examiner* — Todd Manahan
*Assistant Examiner* — Vanitha Elgart
(74) *Attorney, Agent, or Firm* — James Ray & Assoc

(57) ABSTRACT

A cosmetic storage and application device is provided. Such device includes a housing member having a plurality of compartments. Such housing member is manufactured from a first predetermined material and has a first predetermined shape and a first predetermined size. Such device further includes an access mechanism for each of such plurality of compartments. Such device further includes a plurality of predetermined cosmetics, each one of such plurality of predetermined cosmetics being housed within a predetermined compartment. Such device also includes a plurality of predetermined cosmetic applicators, each one of such plurality of predetermined cosmetic applicators being housed within a predetermined corresponding cosmetic compartment.

15 Claims, 3 Drawing Sheets

U.S. PATENT DOCUMENTS

| | | | | |
|---|---|---|---|---|
| 6,138,688 | A * | 10/2000 | Lombardi, Jr. | 132/297 |
| 6,145,515 | A * | 11/2000 | Wu | 132/295 |
| 6,412,640 | B1 * | 7/2002 | Destanque et al. | 206/581 |
| 6,565,276 | B1 | 5/2003 | Diaz | |
| 6,681,780 | B1 * | 1/2004 | Baxter | 132/295 |
| 6,745,900 | B2 * | 6/2004 | Lambert | 206/581 |
| 6,901,937 | B2 * | 6/2005 | Sebban | 132/301 |
| 6,997,321 | B2 * | 2/2006 | Young | 206/581 |
| 7,007,700 | B2 * | 3/2006 | Burroughs | 132/297 |
| 7,040,486 | B2 * | 5/2006 | Godshaw et al. | 206/581 |
| 7,165,559 | B1 | 1/2007 | Goodman | |
| 7,165,906 | B2 | 1/2007 | Dieudonat et al. | |
| D560,312 | S * | 1/2008 | Washington | D28/73 |
| D607,153 | S * | 12/2009 | Campbell et al. | D28/76 |
| 7,743,775 | B2 * | 6/2010 | Thiebaut | 132/294 |
| 2002/0185148 | A1 * | 12/2002 | Bengis | 132/297 |
| 2003/0041870 | A1 * | 3/2003 | Su et al. | 132/297 |
| 2003/0062060 | A1 * | 4/2003 | Burroughs | 132/297 |
| 2003/0154996 | A1 * | 8/2003 | Bourjal | 132/293 |
| 2004/0096258 | A1 | 5/2004 | Kim | |
| 2005/0087207 | A1 * | 4/2005 | Rousselet | 132/318 |
| 2006/0169298 | A1 * | 8/2006 | Thiebaut | 132/294 |
| 2006/0231116 | A1 * | 10/2006 | Kaiser et al. | 132/295 |
| 2007/0234605 | A1 | 10/2007 | Coleman et al. | |
| 2008/0245386 | A1 * | 10/2008 | Steele | 132/318 |
| 2009/0090375 | A1 * | 4/2009 | Tran | 132/73.5 |

* cited by examiner

COSMETIC STORAGE AND APPLICATION DEVICE

CROSS REFERENCE TO RELATED APPLICATION

This patent application is related to and claims priority from U.S. Provisional Patent Application Ser. No. 61/130,346 filed May 30, 2008.

FIELD OF THE INVENTION

The present invention relates, in general, to make-up and cosmetics containers and applicators and, more particularly, this invention relates to a make-up and cosmetics applicator container which can be used to store and apply various make-up items and their corresponding applicators in one container.

BACKGROUND OF THE INVENTION

Prior to the conception and development of the present invention, make-up and cosmetics, as are generally well known in the prior art, have been used to enhance facial features, improve complexions, cultivate self-esteem, and the like. Usually people carry each item separately, such as a tube of lipstick or lip gloss, lip liner, eye liner, eye shadow, blush, concealer, foundation, face powder, mascara, brow gel, and so on. It can be difficult and time consuming to search through a purse or bag to locate each item as needed to apply or refresh make-up. Furthermore, so many items take up a large amount of space and can be quite heavy and cumbersome to carry around. Therefore there is a need for an invention which incorporates a plurality of cosmetics in one easy to use storage and applicator device.

Specifically of interest to the present invention are the following: Dieudonat, U.S. Pat. No. 7,165,906, discloses an applicator of a cosmetic product, typically designed to cooperate with a neck of a holder containing such cosmetic product, for example mascara.

Goodman, U.S. Pat. No. 7,165,559, discloses a cosmetic kit having a backing portion on which there are receptacles for containing cosmetics. Each receptacle contains a cosmetic suitable for use on a different portion of the human face. The receptacles themselves are covered by a mask which overlies the receptacles and has shapes thereon which pictorially represent the portion of the face on which each cosmetic is to be used. The kit may be contained in a carrying case which includes a mirror and a receptacle for cosmetic applicators.

Diaz, U.S. Pat. No. 6,565,276, discloses an electrically driven hand-held device for eyelash mascara application. A power supply is electrically connected through an electrical switch to a reversible motor, the shaft of which is coupled by a connecting means with the rod of an applicator brush, and wherein the reversible motor provides the rotation of the brush with the mascara onto it during engagement with the eyelashes.

Conley, Jr., U.S. Pat. No. 5,715,848 discloses a cosmetic system and method including a housing having a plurality of apertures for receiving a plurality of cosmetic items, such as lipstick, eye liners, brushes, powders and the like, in one portable holder. The system is primarily designed for holding lipstick and includes apertures for press fitting other cosmetics such as eye pencils within such housing.

Segerstrom, U.S. Pat. No. 5,520,203, discloses a makeup kit having various cosmetics mounted in a make-up tray. The kit can be customized for users of different hair colors and complexions. Decision trees are provided to assist users in selecting the optimal kit type.

Mantelet, U.S. Pat. No. 4,056,111 discloses a motor driven cosmetic applicator, particularly for eyelashes.

Coleman, et al, U.S. Publication No. 2007/0234605, discloses a rotatable lipstick or gloss applicator including a container for lipstick or gloss that is attached to a brush handle.

Kim, U.S. Publication No. 2004/0096258, discloses a vibrating lipstick.

None of the aforementioned inventions provides a device which incorporates a plurality of cosmetics and corresponding applicators and which can be easily stored in a purse or bag provides the benefits of the disclosed invention.

SUMMARY OF THE INVENTION

The present invention provides a cosmetic storage and application device. Such device includes a housing member having a plurality of compartments. Such housing member is manufactured from a first predetermined material and has a first predetermined shape and a first predetermined size. Such device further includes access means for each of such plurality of compartments. Such device further includes a plurality of predetermined cosmetics, each one of such plurality of predetermined cosmetics being housed within a predetermined compartment. Such device also includes a plurality of predetermined cosmetic applicators, each one of such plurality of predetermined cosmetic applicators being housed within a predetermined corresponding cosmetic compartment.

OBJECTS OF THE INVENTION

It is, therefore, one of the primary objects of the present invention to provide a combination storage and application device which can house a plurality of cosmetics and corresponding applicators.

Another object of the present invention is to provide an elongated pen type cosmetics storage and application device.

Still another object of the present invention is to provide a simple to use device which can house a plurality of cosmetics such that a user can avoid carrying around various tubes, jars, bottles and containers of cosmetics in favor of such device.

Yet another object of the present invention is to provide a device which includes a mirror, eyeshadow, eyeliner, lip gloss or lip stick, and mascara and/or other types of cosmetics and applicators for same.

An additional object of the present invention is to provide an elongated compartmentalized housing for housing a plurality of different cosmetics and corresponding applicators which can be folded in half such that such device can easily fit in a purse or bag.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
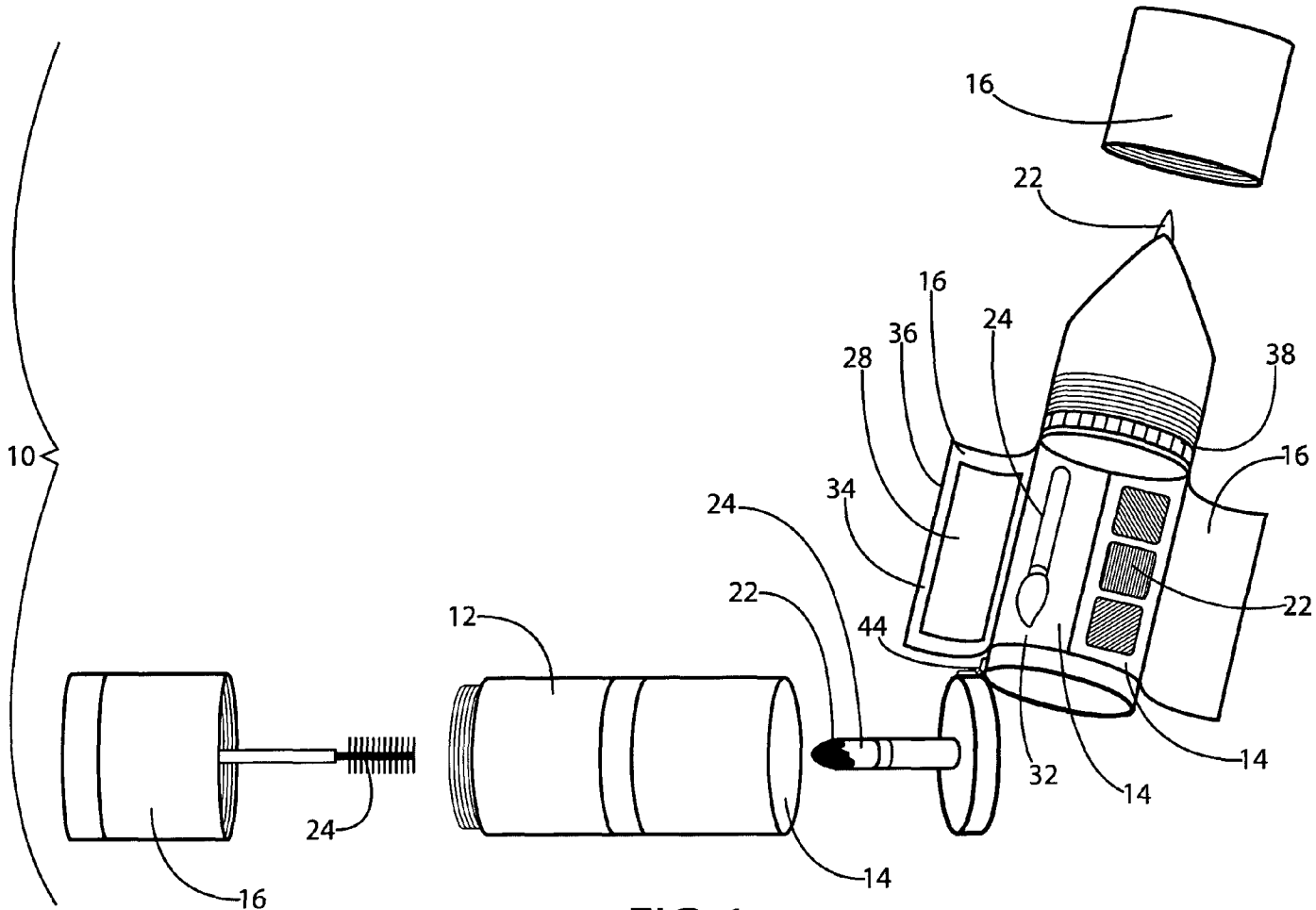
FIG. 1 is a partial perspective view of the invention according to one embodiment of the invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
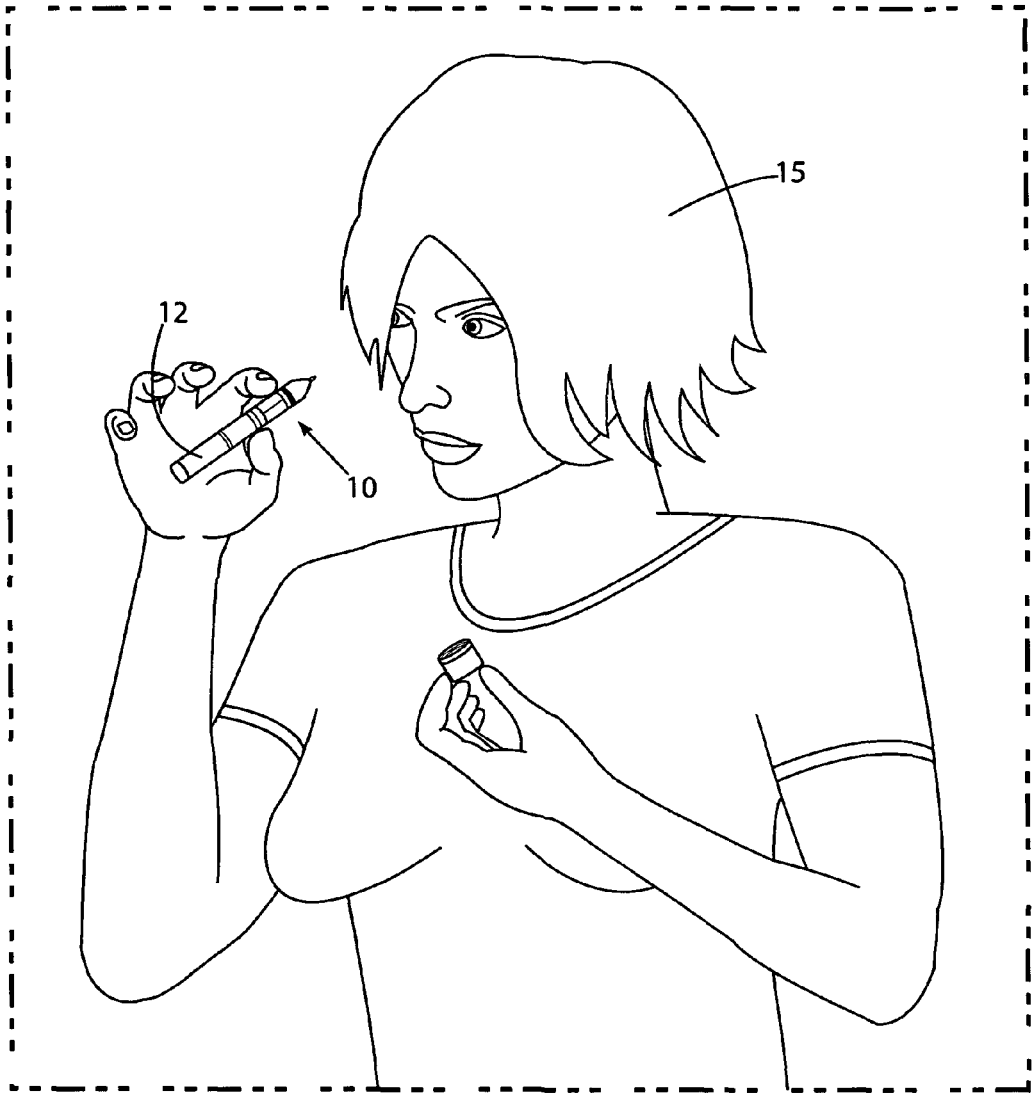
FIG. 2 is a partial perspective view of the invention according to one embodiment of the invention.
Figure 3:
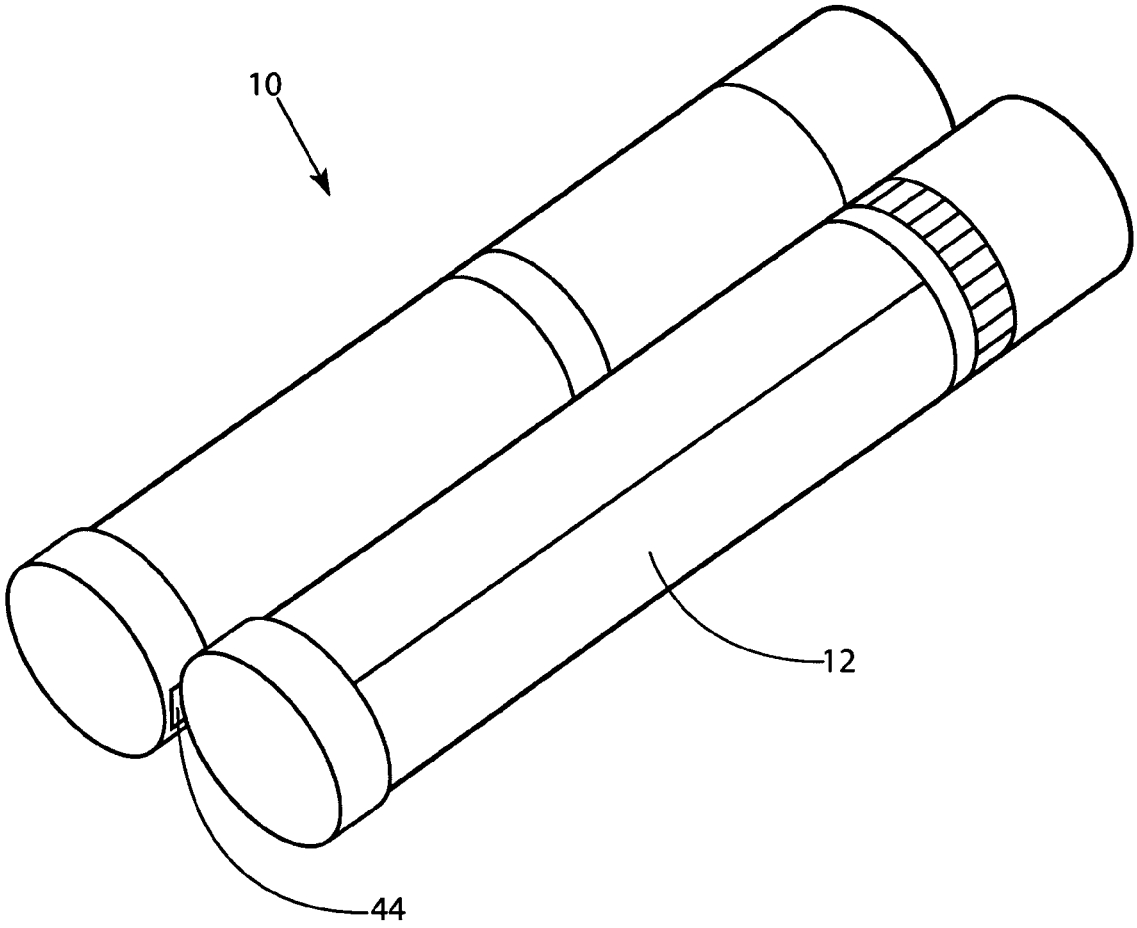
FIG. 3 is a partial perspective view of the invention according to one embodiment of the invention.

Reference is now made, more particularly, to FIGS. 1-3.

The present invention provides a cosmetic storage and application device, generally designated 10.

Such device 10 includes a housing member 12 having a plurality of compartments 14. Such housing member 12 is manufactured from a first predetermined material and has a first predetermined shape and a first predetermined size. It is presently preferred that such first predetermined shape is substantially a cylinder. It is presently preferred that such cylinder has a diameter of between about 1.0 inches and about 2.5 inches. It is presently preferred that such housing member 12 is between about 5.0 inches and about 10.0 inches long. It is further presently preferred that such housing member 12 is substantially transparent.

Such device 10 further includes access means 16 for each of such plurality of compartments 14. It is presently preferred that such access means 16 is at least one of a lid type access means, a cap type access means, a door type access means, and a combination thereof. It is presently preferred that at least two compartments 14 are screwed together and wherein accessing at least one of such two compartments 14 requires a user 15 to unscrew such at least two compartments from one another. However, the device 10 is not meant to be limited as such and any other type of access type means such as pressure fit means, friction fit means, and the like, which reasonably facilitates such purpose of accessing such plurality of compartments 14, may be used.

Such device 10 further includes a plurality of predetermined cosmetics 22, each one of such plurality of predetermined cosmetics 22 being housed within a predetermined compartment 14.

Such device also includes a plurality of predetermined cosmetic applicators 24, each one of such plurality of predetermined cosmetic applicators 24 being housed within a predetermined corresponding cosmetic compartment.

It is presently preferred that such plurality of predetermined cosmetics 22 includes at least two of eye liner, eye shadow, lip gloss, lipstick, mascara, concealer, foundation, blush, face powder, nail polish, nail polish remover, and a combination thereof. However, the device 10 is not meant to be limited as such and any combination of cosmetics 22 and make-up type items may be implemented and incorporated into the device 10.

It is presently preferred that such plurality of predetermined cosmetic applicators 24 includes at least two of an eye shadow applicator, a brush type applicator, a swab type applicator, a powder brush, a blush brush, a powder puff applicator, a mascara brush, a wand type applicator, and a combination thereof. However, such device 10 is not meant to be limited as such and any combination of cosmetic applicators 24 may be implemented.

It is presently preferred that such housing member 12 further includes at least one mirror 28 disposed at least one of on and within such housing member 12 at a predetermined location.

It is presently preferred that a first predetermined compartment 32 has at least one door type access means 34, such door type access means 34 having at least one mirror 28 disposed on an interior portion 36 thereof. In further reference to FIGS. 1 and 3, the at least one door type access means at least includes a pair of doors 34 selectively opening and closing a such first predetermined compartment 32. Each of the pair of doors 34 has one edge thereof mounted for pivotal movement to the elongated hollow housing 12 and having an opposed edge thereof juxtaposed with an edge of an opposed one of the pair of doors 34 when the pair of doors 34 are positioned to cover the first predetermined compartment 32. When the pair of doors 34 are positioned so as to cover the first predetermined compartment 32, the exterior surfaces of the pair of doors 34 are generally aligned with exterior surfaces of adjacent compartments of the elongated housing member 12.

It is presently preferred that such device 10 further includes at least one advancing means 38 for advancing at least one of such plurality of cosmetics 22 from a position substantially within a predetermined compartment to a position at least partially outside of such predetermined compartment. It is presently preferred that such advancing means 38 is at least one of a manual advancing means and an automatic advancing means. It is contemplated that such advancing means may be electronic.

It is presently preferred that such housing member 12 is elongated. It is presently preferred that such elongated housing member further includes at least one hinge 44 disposed at a predetermined location thereon such that such housing member 12 is foldable. Yet in further reference to FIGS. 1 and 3, the at least one hinge 44 has a first portion thereof attached to an exterior surface of one of the plurality of compartments 14 and having a second portion thereof attached to an exterior surface of an adjacent one of the plurality of compartments 14 so that the elongated housing member 12 pivots between a first position wherein all of the plurality of compartments 14 are disposed along a length of the elongated housing member 12 and a second position wherein a first portion of the plurality of compartments 14 is juxtaposed with a second portion of the plurality of compartments 14 and decreasing the length of the elongated housing member 12 being in the first position.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

We claim:

1. A cosmetic storage and application device comprising:

a. an elongated housing member having a plurality of compartments disposed in series with each other, said housing member being manufactured from a predetermined material and having a predetermined shape and a predetermined size;

b. access means for each of said plurality of compartments, wherein a predetermined compartment has at least one door type access means, said door type access means having at least one mirror disposed on an interior portion thereof;

c. a plurality of predetermined cosmetics, each one of said plurality of predetermined cosmetics being housed within a predetermined compartment;

d. a plurality of predetermined cosmetic applicators, each one of said plurality of predetermined cosmetic applicators being housed within a predetermined corresponding compartment; and e. at least one hinge positioned mediate ends of said elongated housing member, said at least one hinge having a first portion thereof attached to an exterior surface of one of said plurality of compartments and having a second portion thereof attached to an exterior surface of an adjacent one of said plurality of compartments so that said elongated housing member pivots between a first position wherein all of said plurality of compartments are disposed along a length of said elongated housing member and a second position wherein a first portion of said plurality of compartments is juxtaposed with a second portion of said plurality of compartments and decreasing said length of said elongated member being in said first position when opened to access said second portion of said plurality of compartments.

2. A cosmetic storage and application device according to claim 1 wherein said plurality of predetermined cosmetics include at least two of eye liner, eye shadow, lip gloss, lipstick, mascara, concealer, foundation, blush, face powder, nail polish, nail polish remover, or a combination thereof.

3. A cosmetic storage and application device according to claim 1 wherein said plurality of predetermined cosmetic applicators include at least two of an eye shadow applicator, a brush type applicator, a swab type applicator, a powder brush, a blush brush, a powder puff applicator, a mascara brush, a wand type applicator, or a combination thereof.

4. A cosmetic storage and application device according to claim 1 wherein said accessing means is at least one of a lid type access means, a cap type access means, a door type access means, or a combination thereof.

5. A cosmetic storage and application device comprising:

a. an elongated housing member having a plurality of compartments disposed in series with each other, said housing member being manufactured from a predetermined material and having a predetermined shape and a predetermined size wherein at least two of said plurality of compartments are screwed together and wherein accessing at least one of said two compartments requires a user to unscrew said at least two compartments from one another;

b. access means for each of said plurality of compartments;

c. a plurality of predetermined cosmetics, each one of said plurality of predetermined cosmetics being housed within a predetermined compartment;

d. a plurality of predetermined cosmetic applicators, each one of said plurality of predetermined cosmetic applicators being housed within a predetermined corresponding compartment; and e. at least one hinge positioned mediate ends of said elongated housing member, said at least one hinge having a first portion thereof attached to an exterior surface of one of said plurality of compartments and having a second portion thereof attached to an exterior surface of an adjacent one of said plurality of compartments so that said elongated housing member pivots between a first position wherein all of said plurality of compartments are disposed along a length of said elongated housing member and a second position wherein a first portion of said plurality of compartments is juxtaposed with a second portion of said plurality of compartments and decreasing said length of said elongated member being in said first position when opened to access said second portion of said plurality of compartments.

6. A cosmetic storage and application device according to claim 1 wherein said device further includes at least one advancing means for advancing at least one of said plurality of cosmetics from a position substantially within a predetermined compartment to a position at least partially outside of said predetermined compartment.

7. A cosmetic storage and application device according to claim 6 wherein said advancing means is at least one of a manual advancing means and an automatic advancing means.

8. A cosmetic storage and application device according to claim 1 wherein said housing member is between about 5.0 inches and about 10.0 inches long.

9. A cosmetic storage and application device according to claim 1 wherein said predetermined shape is substantially a cylinder.

10. A cosmetic storage and application device according to claim 9 wherein said cylinder has a diameter of between about 1.0 inches and about 2.5 inches.

11. A cosmetic storage and application device according to claim 1 wherein said predetermined material of said elongated housing member is substantially transparent.

12. A cosmetic storage and application device comprising:

a. an elongated hollow housing member having a plurality of compartments disposed in series with each other; and b. access means for each of said plurality of compartments, said access means at least including a pair of doors selectively opening and closing a predetermined one of said plurality of compartments, each of said pair of doors having one edge thereof mounted for pivotal movement to said elongated hollow housing and having an opposed edge thereof juxtaposed with an edge of an opposed one of said pair of doors when said pair of doors are positioned to cover said predetermined compartment, whereby exterior surfaces of said pair of doors positioned to cover said predetermined compartment are generally aligned with exterior surfaces of adjacent compartments.

13. The cosmetic storage and application device of claim 12, including a plurality of predetermined cosmetics, each one of said plurality of predetermined cosmetics being housed within a predetermined compartment.

14. The cosmetic storage and application device of claim 12, including a plurality of predetermined cosmetic applicators, each one of said plurality of predetermined cosmetic applicators being housed within a predetermined corresponding compartment.

15. The cosmetic storage and application device of claim 12, including at least one mirror disposed on an interior portion of a respective one of said pair of doors.

* * * * *